US009284179B2

(12) United States Patent
Clancy et al.

(10) Patent No.: US 9,284,179 B2
(45) Date of Patent: Mar. 15, 2016

(54) LIQUID AND OR ICE DISPENSING SYSTEM

(75) Inventors: Tim Clancy, Orange (AU); Lyndon Craig, Sydney (AU); Vijay Paliwal, Orange (AU); Nagarajan Muthusamy, Orange (AU)

(73) Assignee: Electrolux Home Products Pty Limited, New South Wales (AU)

( * ) Notice: Subject to any disclaimer, the term of this patent is extended or adjusted under 35 U.S.C. 154(b) by 109 days.

(21) Appl. No.: 13/989,267

(22) PCT Filed: Nov. 24, 2011

(86) PCT No.: PCT/AU2011/001516

§ 371 (c)(1),
(2), (4) Date: Oct. 29, 2013

(87) PCT Pub. No.: WO2012/068625

PCT Pub. Date: May 31, 2012

(65) Prior Publication Data

US 2014/0042186 A1 Feb. 13, 2014

(30) Foreign Application Priority Data

Nov. 24, 2010 (AU) ..... 2010905201

(51) Int. Cl.

| | |
|---|---|
| ***B67D 7/06*** | (2010.01) |
| ***B67D 7/36*** | (2010.01) |
| ***B67D 1/00*** | (2006.01) |
| ***F25D 23/12*** | (2006.01) |
| ***F25C 5/00*** | (2006.01) |

(52) U.S. Cl.

CPC ..... *B67D 7/36* (2013.01); *B67D 1/0003* (2013.01); *F25C 5/005* (2013.01); *F25D 23/126* (2013.01); *F25C 2400/10* (2013.01)

(58) Field of Classification Search

CPC ..... B67D 7/36; B67D 7/0288; B67D 1/0003; B67C 3/242; B67C 3/26; B67C 3/2637; B67C 3/264; B67C 2003/266; B67C 2003/268; F25C 5/005; F25C 2400/10; F25D 23/126

USPC ..... 222/144.5, 153.02, 153.14, 505, 509, 222/402.1; 62/389, 390, 98; 141/351, 331, 141/353, 360, 361, 362, 311 R, 372

See application file for complete search history.

(56) References Cited

U.S. PATENT DOCUMENTS

| | | | | |
|---|---|---|---|---|
| 1,923,585 | A * | 8/1933 | Reeves | 222/505 |
| 3,411,552 | A * | 11/1968 | Love | 141/198 |
| 3,923,085 | A * | 12/1975 | Nimer | 141/261 |

(Continued)

OTHER PUBLICATIONS

International Search Report mailed Feb. 20, 2012 in corresponding International Application No. PCT/AU2011/001516.

*Primary Examiner* — J. Casimer Jacyna
*Assistant Examiner* — Benjamin R Shaw
(74) *Attorney, Agent, or Firm* — Banner & Witcoff, Ltd.

(57) ABSTRACT

A liquid (24) and or ice (60) dispensing system (10) for a door or wall (14) mounted dispenser of an appliance is provided. The system (10) includes a source of liquid (24) and or ice (60) which is adapted to be delivered to a dispensing outlet (24, 60). The source is controlled by a valve means which can be activated by at least one switch means (22) associated with said system (10). The switch means (22) is activated by movement of an actuator means (12) through which said outlet (24, 60) dispenses said liquid (24) or ice (60). The actuator means (12) includes a formation (30) comprising a portion extending away from the actuator means (12).

21 Claims, 7 Drawing Sheets

(56) References Cited

U.S. PATENT DOCUMENTS

| | | | | |
|---|---|---|---|---|
| 6,152,020 | A * | 11/2000 | Ikuta | 99/352 |
| 6,206,238 | B1 * | 3/2001 | Ophardt | 222/1 |
| 6,267,272 | B1 * | 7/2001 | Shin | 222/505 |
| 6,651,449 | B2 * | 11/2003 | Heims et al. | 62/98 |
| 6,708,741 | B1 * | 3/2004 | Berry et al. | 141/362 |
| 7,188,487 | B2 * | 3/2007 | Choi | 62/389 |
| 7,810,676 | B2 * | 10/2010 | Romanyszyn et al. | 222/129.1 |
| 2006/0144075 | A1 * | 7/2006 | Bowen et al. | 62/344 |
| 2007/0113924 | A1 * | 5/2007 | Phillips, Jr. | 141/351 |
| 2008/0184730 | A1 * | 8/2008 | Voglewede et al. | 62/389 |
| 2009/0158766 | A1 * | 6/2009 | Cooper et al. | 62/389 |
| 2010/0043480 | A1 * | 2/2010 | Koo et al. | 62/389 |
| 2010/0175417 | A1 * | 7/2010 | Kim | 62/389 |
| 2010/0319389 | A1 * | 12/2010 | Yang et al. | 62/389 |
| 2011/0132021 | A1 * | 6/2011 | Fulton et al. | 62/389 |
| 2011/0259033 | A1 * | 10/2011 | Froehlich | 62/344 |
| 2012/0181304 | A1 * | 7/2012 | Kim | 222/182 |
| 2013/0098949 | A1 * | 4/2013 | Dirnberger et al. | 222/517 |
| 2013/0118203 | A1 * | 5/2013 | Seo et al. | 62/389 |

* cited by examiner

LIQUID AND OR ICE DISPENSING SYSTEM

FIELD OF THE INVENTION

The present invention relates to liquid and or ice dispensing systems, more particularly those related with refrigerator and or freezer ice and or water dispensing facilities, such as those mounted in the front door panels of such appliances.

BACKGROUND OF THE INVENTION

Prior art water and ice dispensing systems are directed to the filling of cups and glasses, whether with or without ice cubes or crushed ice. There has been a need to provide an alternative system which has wider application than those previously known systems.

In WO2008/096982 and U.S. Pat. No. 6,651,449 there are described water and ice dispensing systems each of which requires actuation of a switch for the delivery of water from a spout and or ice from a chute which is located away from the actuator of the relevant switch.

Any reference herein to known prior art does not, unless the contrary indication appears, constitute an admission that such prior art is commonly known by those skilled in the art to which the invention relates, at the priority date of this application.

SUMMARY OF SELECTED INVENTIVE ASPECTS

In an aspect, the present invention provides a liquid and or ice dispensing system for a door or wall mounted dispenser of an appliance, said system including a source of liquid and or ice which is adapted to be delivered to a dispensing outlet, said source being controlled by a valve means which can be activated by at least one switch means associated with said system, said switch means being activated by movement of an actuator means through which said outlet dispenses said liquid or ice, said actuator means including a formation comprising a portion extending away from the actuator.

The formation can include a wall having a tapered portion which converges as it extends away from the actuator means.

The formation can include a part conical or frusto-conical portion.

The formation can have a semi-circular or crescent shaped construction.

The actuator means can be adapted to be motivated by a user pushing an open bottle or receptacle against the actuator means to dispense liquid and or ice into the bottle.

The outlet can be oriented at an angle to a vertical axis or vertical plane of a door or wall of an appliance cabinet in which the system is adapted to be mounted.

The angle can be such that water and or ice dispensed from the outlet travels downward and away from a user of the system.

The actuator means can be located close to or adjacent a forward most panel of an appliance door or cabinet.

The actuator means can be located in an ice and water dispensing apparatus, so that the actuator means is adjacent to an ice dispensing outlet.

A second actuator means, located below the first mentioned actuator means, can be able to activate the valve, independently of the first mentioned actuator means, so as to dispense liquid and or ice from the outlet.

The first and second actuators can be locked to prevent usage by said user via a user interface.

The first mentioned actuator can be selectively unlocked via a user interface independently of said second actuator.

The actuator means can be wider than it is deep.

The actuator means can be able to be activated by a finger of a user, when an opening surrounded by a rim of a bottle or receptacle is also placed near to the lever.

The actuator means can be a lever means.

The positional relationship of the formation and the actuator means and or the shape of the formation, is such that a user can apply by means of a receptacle or a finger of their hand, a force to the formation and or the flap, the force being in a generally vertical direction or in a generally horizontal direction or in an arcuate path or in a path that has both a vertical and horizontal component of direction, so as to activate the valve.

The system can be located in an ice and water dispensing system module adapted to be mounted into or on a door or cabinet of an appliance.

A third actuator can be provided for dispensing ice.

The user interface can operate to perform one or more of the following:

a) lock or unlock all three levers independently;

b) lock or unlock all three levers simultaneously;

c) lock or unlock said third actuator independently of locking or unlocking said first and second actuators which are locked or unlocked simultaneously.

Once one or both of said first and second actuators are unlocked, and said third actuator can be unlocked, then said ice and or water is able to be dispensed without having to interact with said user interface.

The actuator can be moveable by a user in a generally vertical direction or a generally horizontal direction, or an arcuate direction, or in a combination of vertical and horizontal directions to cause the dispensing of said liquid and or ice from said outlet.

The present invention also provides an appliance having a liquid and or ice dispensing system as described above.

The appliance can be a freezer or a refrigerator.

The water dispensing system can be mounted in a door of said appliance.

The present invention also provides a liquid and or ice dispensing system being substantially as described herein with reference to the accompanying Figures of the drawings.

The present invention further provides an appliance, such as a refrigerator or a freezer, being substantially as herein described with reference to the accompanying Figures of the drawings.

In the case of a liquid the valve means can be a solenoid valve or other valve suitable for starting and stopping the flow of liquid, such as water, whereas for ice the valve means can be a gate or flap to close off a chute or in the case of crushed ice can be a switch to start and or stop a crusher or shaving system elsewhere located on the appliance, whereupon the activation of said switch causes ice or crushed or shaved ice to flow or not to flow to the outlet of the dispenser.

BRIEF DESCRIPTION OF THE DRAWINGS

An embodiment or embodiments of the present invention will now be described, by way of example only, with reference to the accompanying drawings, in which.

DETAILED DESCRIPTION OF EXAMPLE EMBODIMENTS

Figure 7:
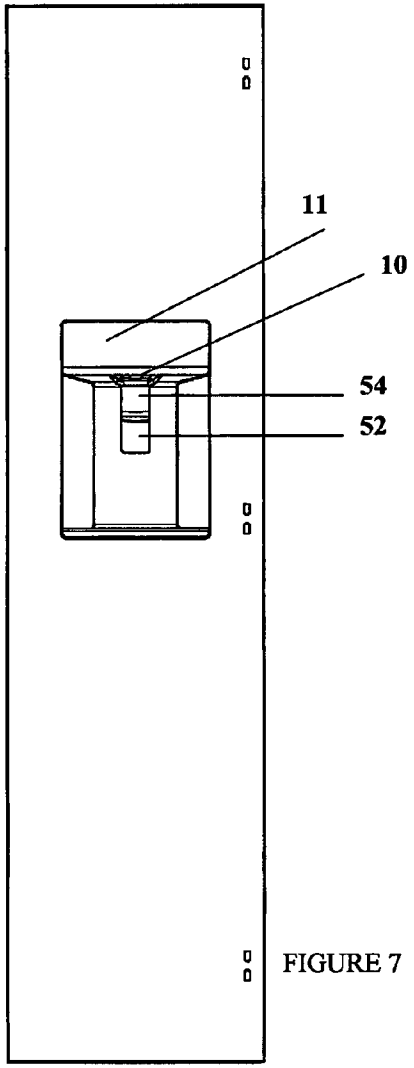
FIG. 7 is a front view of a freezer door panel having a water dispensing system of preceding Figures.

Illustrated in FIGS. 1 to 5 is a water dispensing system 10 which is adapted to be inserted into an ice and water dispensing system for a refrigerator or freezer to be mounted in a door panel or a cabinet wall. Illustrated in FIG. 7 is the water dispenser 10 shown in a door panel and further reference will be made to this FIG. 7 below.

Figure 1:
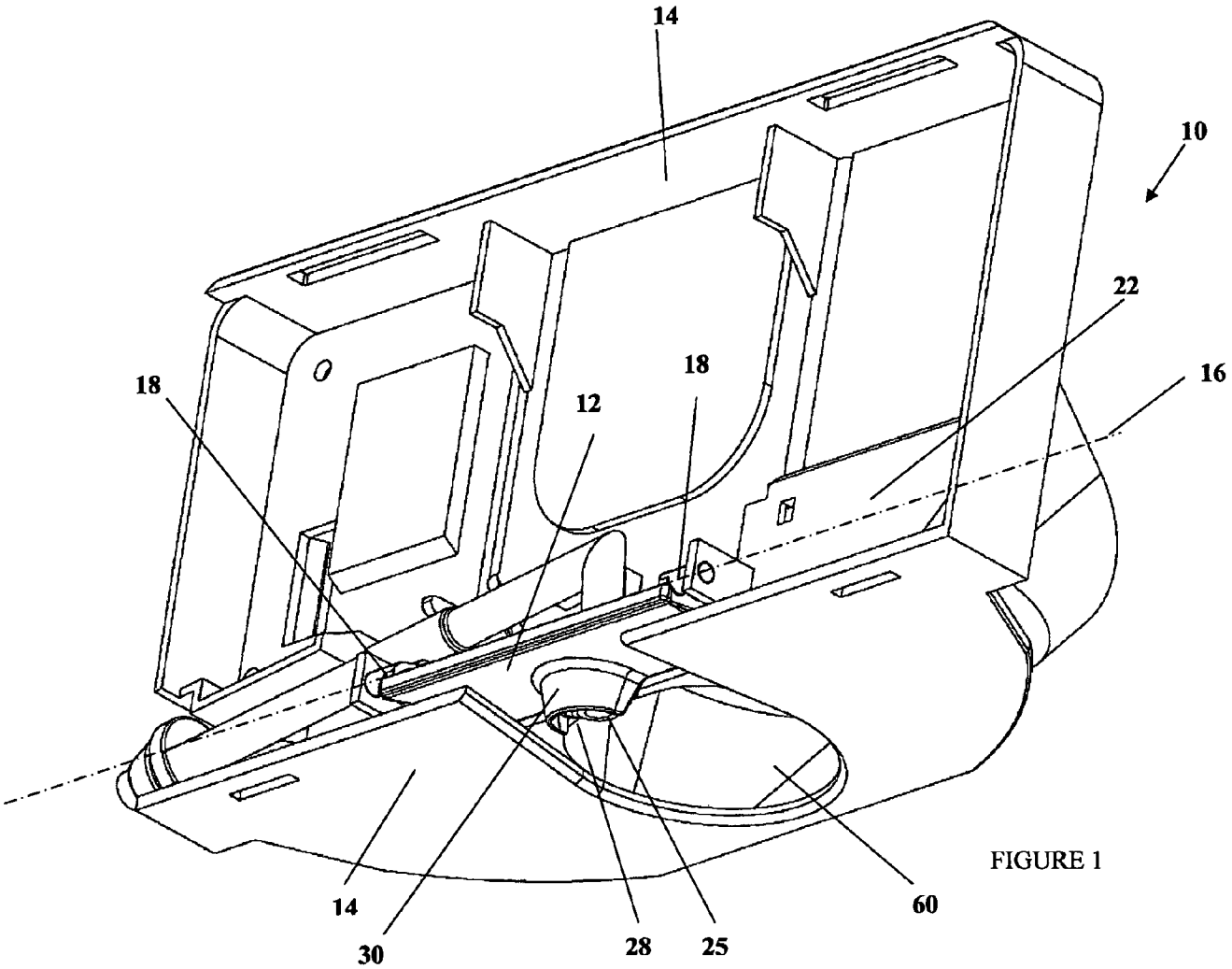
FIG. 1 is an underneath right hand side perspective of a water dispensing system.
Figure 2:
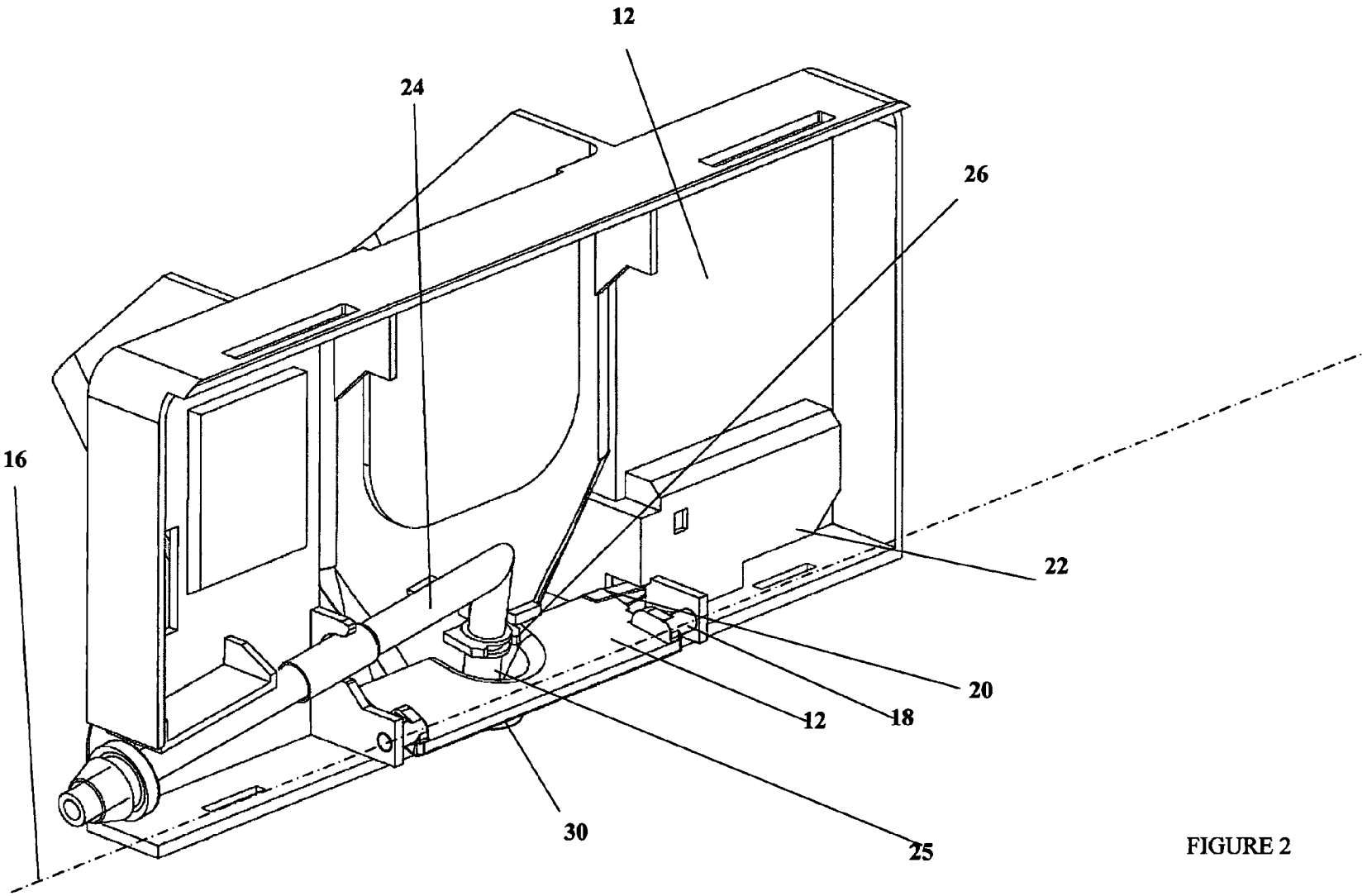
FIG. 2 is a front upper perspective view of the system of FIG. 1.

The water dispensing system 10 includes an actuator or flap 12 mounted in a housing 14 with a generally horizontal axis of rotation 16 which is in turn created by a left and right side pivots 18 which pass through respective holes in the relatively stationary housing 14 as is best visible in FIG. 2. The flap 12 interacts with a switch lever or switch actuator 20 which in turn is connected to a switch mechanism 22. The switch 22 will open a valve, such as a solenoid valve, associated with a water delivery tube 24.

Figure 6:
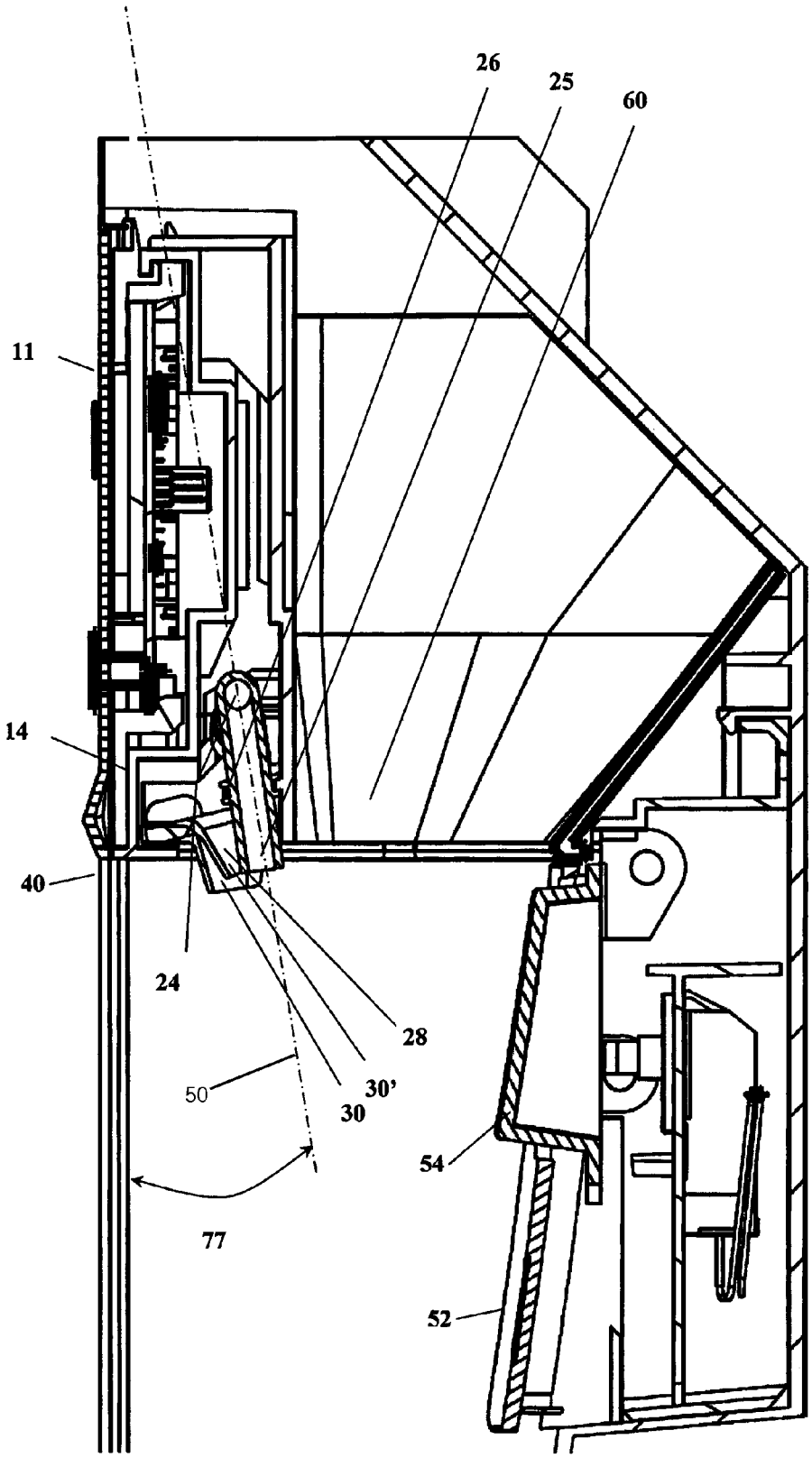
FIG. 6 is a cross sectional view of a water and ice dispensing system having the water dispensing system of FIG. 1.

The water delivery tube 24 is secured to the housing 14 by means of a part circular formation 26. The formation 26 as visible in FIG. 2 has a downward angle orientation as best seen in FIG. 6. By rotation the flap 12 around its pivots 18 the lever 20 is activated and the switch 22 opens the valve allowing water to be ejected from the outlet 25 of tube 24 or a nozzle mounted on the end of thereof.

As is illustrated in the Figures the flap 12 includes a passage or aperture 28 through it (the aperture 28 being of a semicircular shape) and through which the outlet 25 can dispense water. This is better illustrated in FIGS. 4 and 6. The flap 12 has, surrounding the. aperture 28, a crescent or C shaped spout or wall formation 30 which is of a conical or part conical or frusto-conical shape and extends away from the body of the flap 12 in a generally downward direction. The C or crescent shape can be best viewed in FIGS. 4 and 6. The wall 30 by having a generally converging shape as it extends downwardly is used for the alignment of an opening surrounded by a rim of a bottle to be filled. By a user placing a bottle relative to the wall 30 so that the wall 30 enters the opening at the top of the bottle, by further applying force via the bottle, in the direction upwardly and towards the flap 12, the lever 20 and switch 22 will be activated to allow water to be ejected into the bottle from the outlet 25.

If desired once a bottle is located in this region, as bottles generally neck up to a relatively small diameter opening, a user can manually activate the flap 12 by using one or two fingers to rotate it, thereby causing water to be ejected.

It will be noted from the Figures, particularly FIG. 6, that the outlet 25 of the tube 24 and the wall 30 are located close to a forward position on the housing 14 so as to be close to a forward fascia panel 40 of the refrigerator panel or cabinet. An advantage of locating the outlet 25 of the tube 24 and the spout or wall 30 in this location, is that if an operator wishes to fill a jug or pitcher with water, the user is able to locate the larger opening of the jug or pitcher, by comparison to a bottle, under the spout or wall 30 and activate the flap 12 with their fingers, particularly if the shape and size of the jug will not actuate the flap 12 and or occlude other actuation means. With prior art water dispensing systems which have levers on the inside at a relatively much deeper location, it is difficult to actuate such levers because placing the opening of a jug or pitcher at the right location means it must first be oriented at an odd angle and secondly the jug or pitcher generally covers the activating levers, but they cannot be pushed because to do so means the receptacle opening is not aligned with the water outlet. By the flap 12 being located above and activated in an upward direction and oriented to rotate about a horizontal axis, as it is in the Figures, by means of motion being imparted to the flap 12 ready activation of the valve is achieved. Such motion can be in a vertical direction or a horizontal direction, or by a motion having both components of direction, or by means of an arcuate motion.

The wall 30, by its outside surface being of a tapered or converging downward shape, allows the user to centre the opening in the bottle relative to the outlet 25 of the tube 24. Once the bottle is located around the spout or wall 30, movement of the bottle opening towards the wall 30 in a horizontal direction, by the leverage system produced by the positional relationship between the wall 30 and flap 12, and by the tapered outer surface of the wall 30, will cause the rotation of the flap 12 about its pivots 18 to activate the lever 20 and switch 22. This dual operation of both movement having a vertical component and or a horizontal component towards the appliance, will produce vertically upward translation or vertically upward rotation of the flap 12 around its rotation axis, to produce a vertical force on the lever 20 to actuate switch 22 to in turn activate the valve to open allowing water to be dispensed. This produces a versatile and more convenient system to use than prior art systems.

As is illustrated in FIG. 6, being a left hand side cross sectional view, it can be seen that the outlet 25 of the tube 24 is located at an angle to the vertical plane represented by the line 50. The outlet 25 of the tube 24 is located at an angle 77 to the vertical plane, that angle 77 being such that the tube outlet 25 extends downward and towards the door or cabinet or housing 14. The size of this angle is of the order of 10 to 30 degrees. This angle 77 ensures that ejected water is directed towards the cabinet or the appliance, so as not to spill on the floor. Further, as the water dispensing system 10 is separately able to be activated by second actuator or lever 52, as illustrated in FIG. 7, if a user activates the lever 52 water is ejected from the outlet 25 towards the lever 52 (and away from the user) so as to enter into an opening of a cup that has been used to activate the lever 52. The angle 77 also allows the system to be more versatile in that a smaller diameter cup or receptacle can be used with the system 10, by comparison to prior art systems. This in turn allows users with smaller hands to use the system 10 more confidently.

Figure 3:
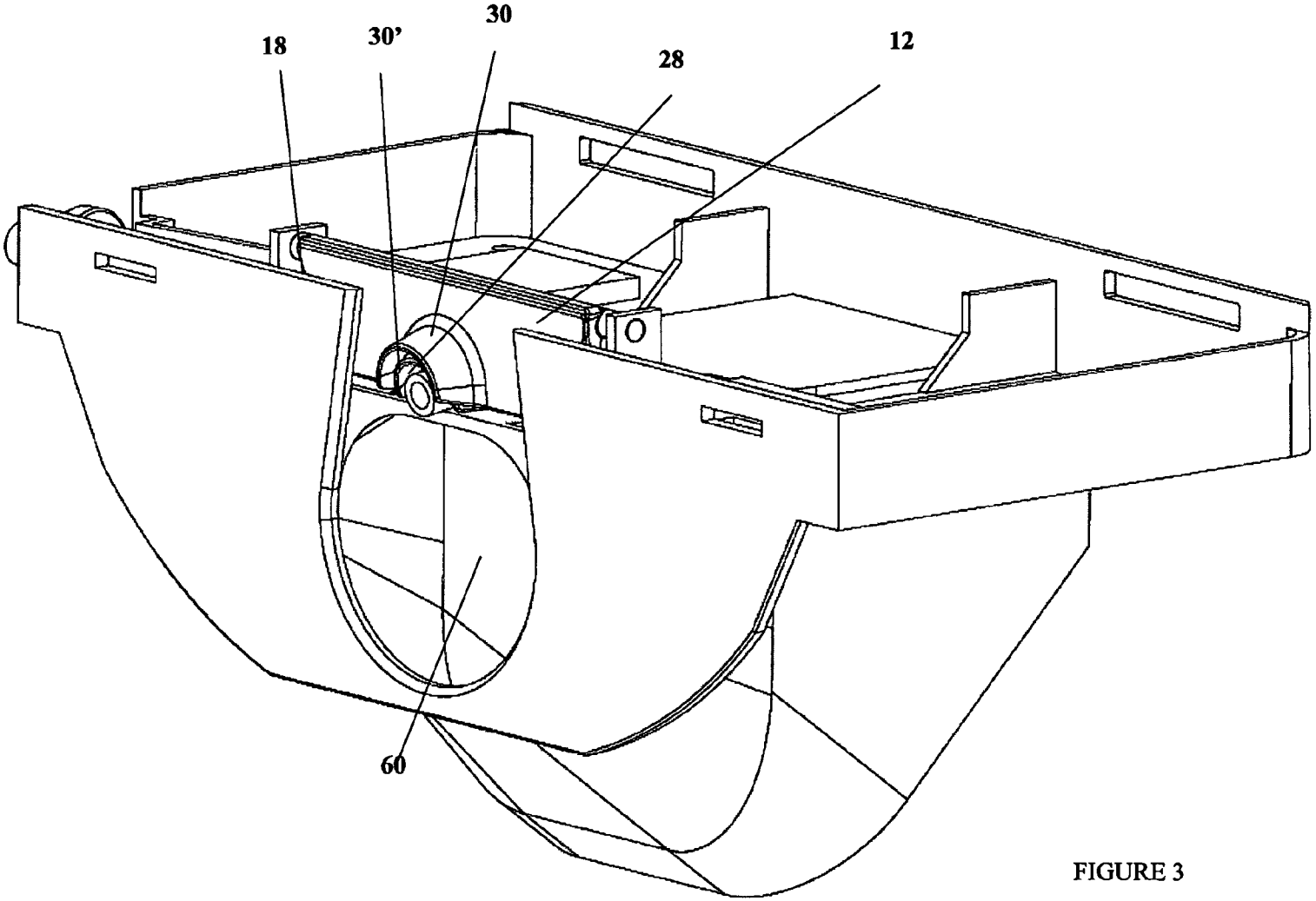
FIG. 3 is an underneath perspective view of FIG. 1 from another angle.
Figure 4:
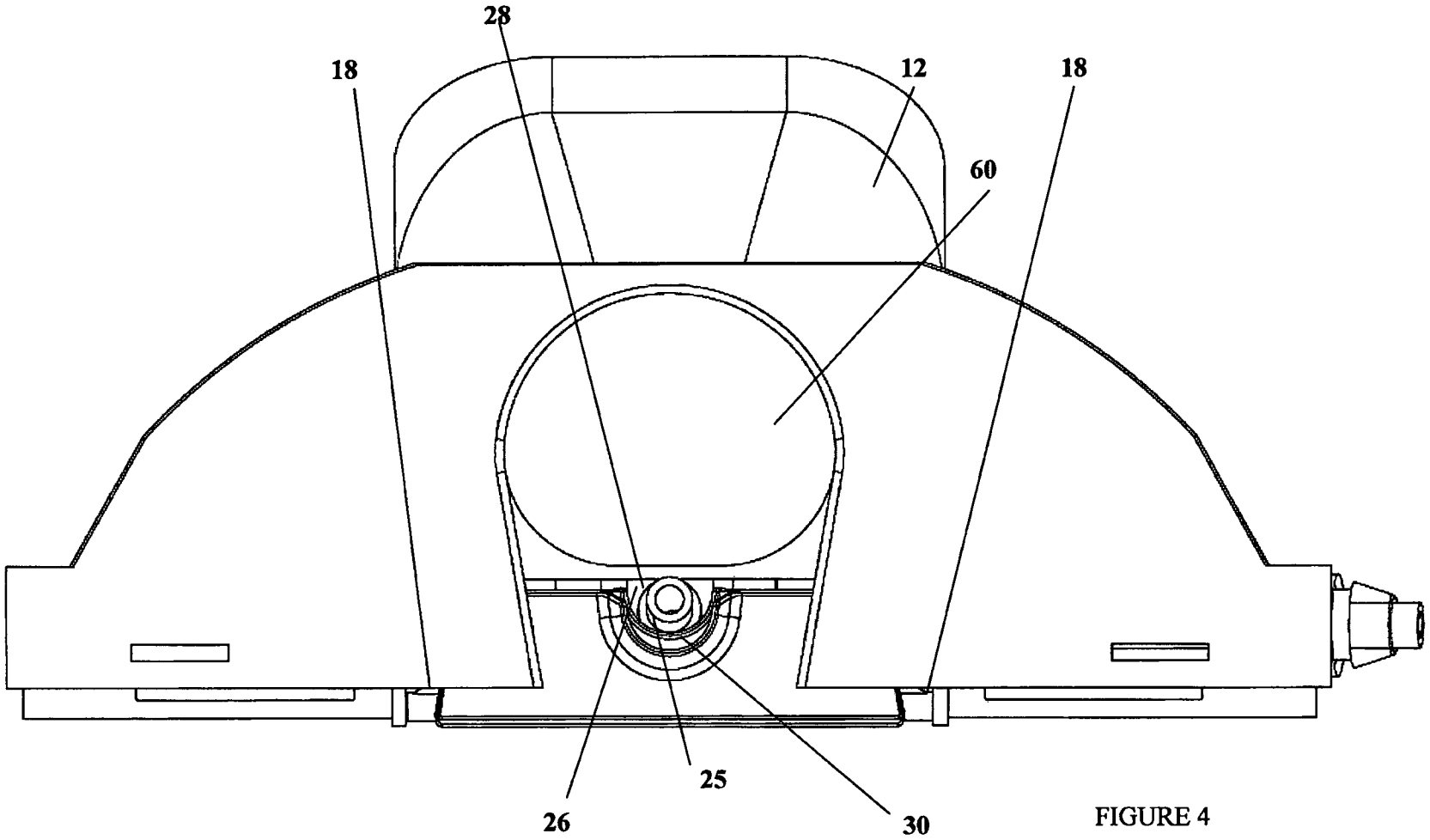
FIG. 4 is an underneath view of the system of FIG. 1.
Figure 5:
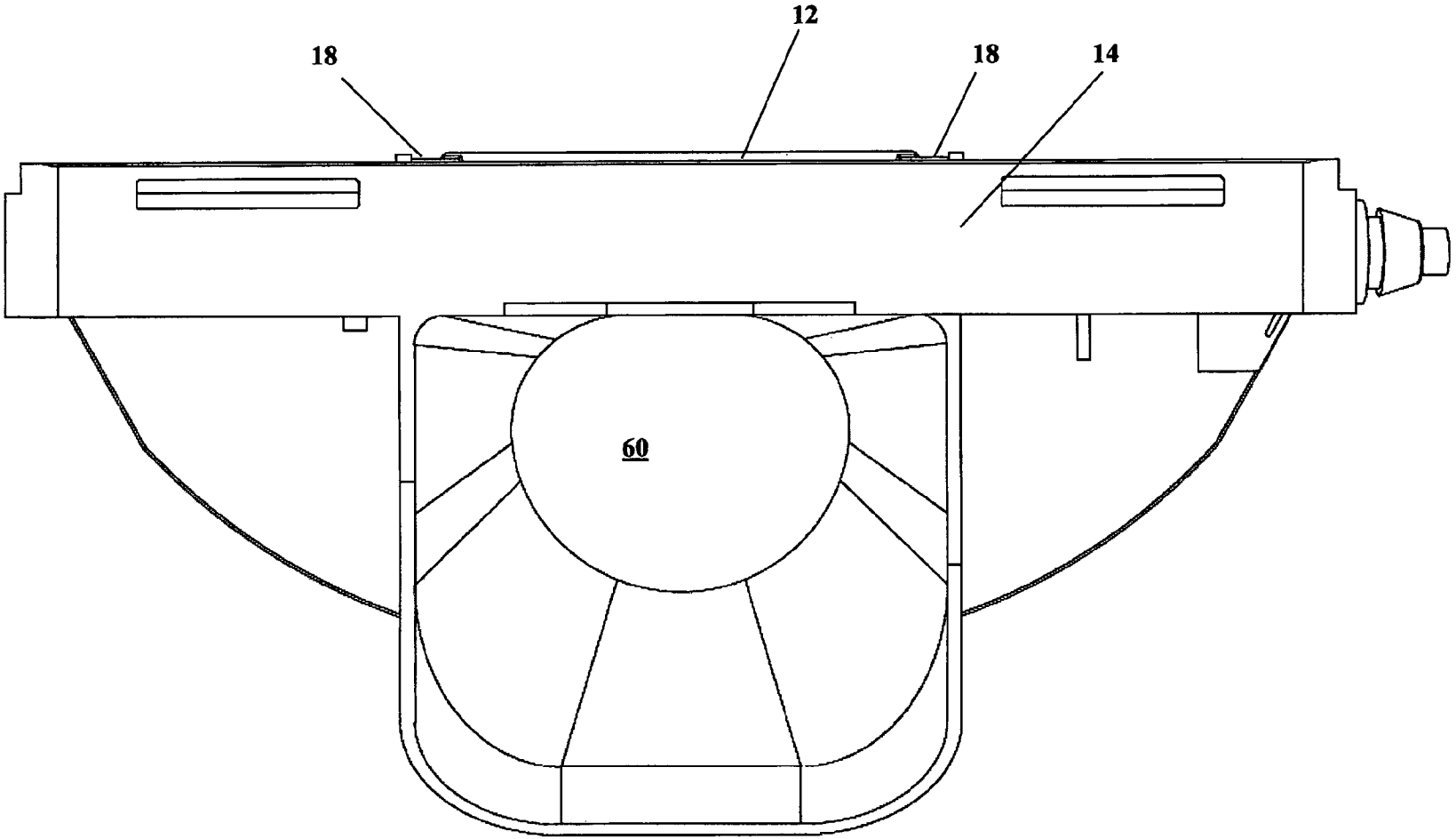
FIG. 5 is a plan view of the system of FIG. 1.

As is illustrated in FIGS. 3 and 6, there are indicated wall 30 and wall 30'. The position of the wall 30 is when the flap 12 is at its inactivated or rest location, whereas the wall 30' shows the position the wall will be in when the flap 12 is at the limit of its rotation and activates the valve to open. The flap 12 can be biased by a torsion spring (not shown) or similar to its inactivated or rest location.

The housing 14 includes an ice dispensing chute 60 which is located adjacent to the water outlet 25. This can be advantageous in that a user can be able to, when the control system allows it, when using a cup, glass or pitcher, to dispense both ice from outlet 60 and water from outlet 25 by simultaneously activating the flap 12 or lever 52 together with a third actuator or lever 54 or by the user interface being activated so that both ice and water dispenses with just the activation of the flap 12.

By the flap 12 being significantly wider than the wall or spout formation 30 this ensures that a user is able to activate the flap 12 even though a bottle might be surrounding the spout 30.

While the water dispensing system 10 is illustrated in FIG. 7 with respect to a door of a fridge or freezer it will be readily understood that this unit could be located in a side wall of a cabinet of a freezer or refrigerator if required or desired.

The control system which includes a user interface 11 (seen in FIGS. 6 and 7) of the water dispensing system 10 is set up so that actuators 12, 52 and 54 can be electronically locked independently of each other to prevent actuation. Further once unlocked, each of the actuators 12, 52 and 54 can be activated without the user having to utilise the user interface 11.

Figure 8:
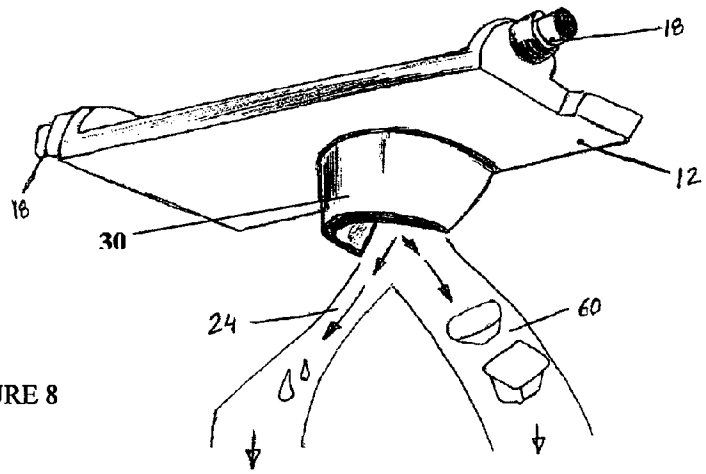
FIGS. 8 and 9 illustrate an upper and lower schematic perspective view of an actuator and ice and water delivery tubes for dispensing through an actuator.
Figure 9:
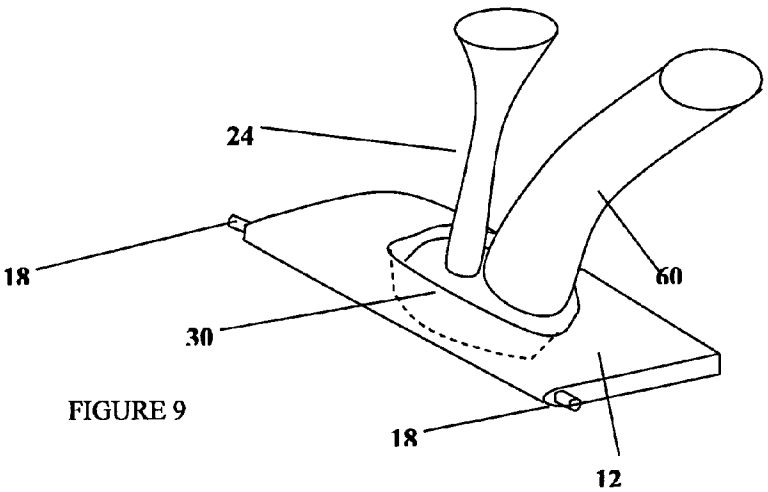

The foregoing description has been made with respect to a water dispensing system in a refrigerator or a freezer system. However, this is an embodiment of the invention and the invention can be applied to the dispensing of other liquid in other appliances, or other liquid (such as milk, other drinks, premixed drinks, whether water or alcohol based) in refrigerator or freezer systems, or ice systems in refrigerator and or freezer systems or ice in other appliances, or combination of liquid and ice dispensing in such appliances. The actuator can have a single spout or chute through it, with the spout or chute dispensing both ice and liquid, or it can have a multiple outlets through it for dispensing through respective outlets, as illustrated in FIGS. 8 and 9.

In the case of a liquid the valve means actuated by the actuator can be a solenoid valve or other valve suitable for starting and stopping the flow of liquid, such as water. Whereas for ice the valve means can be a gate or flap to close off an ice chute or in the case of crushed ice can be a switch to start and or stop a crusher or shaving system elsewhere located on the appliance, or a combination of the two. Whereupon the activation of the switch causes ice or crushed ice or shaved ice to flow, or not to flow, to the outlet of the dispenser.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A liquid and or ice dispensing system for a door or wall mounted dispenser of an appliance, said system including a source of liquid and or ice which is adapted to be delivered to a dispensing outlet, said source being controlled by a valve which can be activated by at least one switch associated with said system, said switch being activated by movement of an actuator, said outlet being arranged to dispense said liquid or ice such that it passes through said actuator, said actuator comprising a first portion and a formation comprising a second, tapered portion which converges as it extends away from the first portion, said actuator being pivotable upwardly about an axis to activate said switch, said first and second portions establishing a leverage system, whereby such upward pivoting of the actuator results from horizontal pressing against said second portion.

2. A liquid and or ice dispensing system as claimed in claim 1, wherein said formation includes one or a combination of more than one of the following: a part conical or frusto-conical portion; and a semi-circular or crescent shaped construction.

3. A liquid and or ice dispensing system as claimed in claim 1, wherein said actuator is adapted to be activated by a user pushing an open bottle or receptacle against said actuator to dispense liquid and or ice into said bottle or receptacle.

4. A liquid and or ice dispensing system as claimed in claim 1, wherein said system is configured to be mounted in an appliance cabinet with said outlet oriented at an angle to a vertical axis or vertical plane of a door or wall of the appliance cabinet.

5. A liquid and or ice dispensing system as claimed in claim 4, wherein said angle is such that liquid and or ice dispensed from said outlet travels downward and inward away from a user of said system positioned in front of the appliance.

6. A liquid and or ice dispensing system as claimed in claim 1, wherein a second actuator is provided, located below said first actuator, said second actuator being able to activate said valve independently of said first actuator, so as to dispense liquid and or ice from said outlet.

7. A liquid and or ice dispensing system as claimed in claim 6, wherein said first and second actuators can be locked to prevent usage by said user via a user interface.

8. A liquid and or ice dispensing system as claimed in claim 6, wherein said first actuator can be selectively unlocked via a user interface independently of said second actuator.

9. A liquid and or ice dispensing system as claimed in claim 1, wherein the positional relationship of said formation and said first portion and or the shape of said formation, is such that a user can apply by means of a receptacle or a finger of their hand, a force to said formation and or said first portion, so as to activate said valve.

10. A liquid and or ice dispensing system as claimed in claim 9, wherein a second actuator is provided, located below the first actuator, said second actuator being able to activate said valve independently of said first actuator, so as to dispense liquid and or ice from said outlet.

11. A liquid and or ice dispensing system as claimed in claim 10, wherein a third actuator, for dispensing ice, is provided.

12. A liquid and or ice dispensing system as claimed in claim 11, further comprising a user interface which operates to perform one or more of the following:

a) lock or unlock all three actuators independently;
b) lock or unlock all three actuators simultaneously;
c) lock or unlock said third actuator independently of locking or unlocking said first and second actuators which are locked or unlocked simultaneously.

13. A liquid and or ice dispensing system as claimed in claim 1, wherein once one or both of said first and second actuators are unlocked, and said third actuator is unlocked, then said liquid and or ice is able to be dispensed without having to interact with said user interface.

14. A liquid and or ice dispensing system as claimed in claim 1 characterised by one or a combination of more than one of the following: said liquid is water;

said liquid and ice can be dispensed independently or simultaneously through one outlet or a multiple of outlets through said actuator; said system is located in an ice and water dispensing system module adapted to be mounted into or on a door or cabinet of an appliance.

15. An appliance having a liquid and or ice dispensing system as claimed in claim 1.

16. An appliance as claimed in claim 15, wherein said appliance is characterised by one or a combination of more than one of the following: it is a freezer or a refrigerator; said liquid and or ice dispensing system is mounted in a door of said appliance;

said liquid and or ice dispensing system is mounted in a wall of said appliance; said liquid is water; said liquid is a premixed drink.

17. A liquid or ice dispensing system as claimed in claim 1, wherein said actuator is upon installation located close to or adjacent a forward most panel of an appliance door or cabinet.

18. A liquid or ice dispensing system as claimed in claim 1, wherein said actuator is located in an ice and water dispensing apparatus, so that said actuator is adjacent to an ice dispensing outlet.

19. A liquid or ice dispensing system as claimed in claim 1, wherein said actuator is wider than it is deep.

20. A liquid or ice dispensing system as claimed in claim 1, wherein said actuator comprises a lever moveable by a user or by a receptacle held by a user.

21. A liquid or ice dispensing system as claimed in claim 1, wherein said actuator is moveable in one or more than one of the following ways to cause the dispensing of said liquid from said outlet: in a generally vertical direction; in a generally horizontal direction; in an arcuate path; in a path that has both a vertical and horizontal component of direction; activated by a finger of a user, when an opening surrounded by a rim of a receptacle is also placed near to said actuator.

* * * * *